US008117995B2

(12) United States Patent
Pellikka

(10) Patent No.: US 8,117,995 B2
(45) Date of Patent: Feb. 21, 2012

(54) METHOD OF AND AN APPARATUS FOR PROTECTING A HEAT EXCHANGER AND A STEAM BOILER PROVIDED WITH AN APPARATUS FOR PROTECTING A HEAT EXCHANGER

(75) Inventor: Jorma Pellikka, Kauniainen (FI)

(73) Assignee: Foster Wheeler Energia Oy, Espoo (FI)

( * ) Notice: Subject to any disclaimer, the term of this patent is extended or adjusted under 35 U.S.C. 154(b) by 964 days.

(21) Appl. No.: 11/658,142

(22) PCT Filed: Jun. 29, 2005

(86) PCT No.: PCT/FI2005/000303

§ 371 (c)(1),
(2), (4) Date: May 2, 2008

(87) PCT Pub. No.: WO2006/008329

PCT Pub. Date: Jan. 26, 2006

(65) Prior Publication Data

US 2008/0264612 A1 Oct. 30, 2008

(30) Foreign Application Priority Data

Jul. 23, 2004 (FI) ..... 20041015

(51) Int. Cl.
*F28D 15/00* (2006.01)

(52) U.S. Cl. ..... 122/7 R; 165/104.19

(58) Field of Classification Search ..... 122/7 R, 122/33, 406.1, 408.1, 409; 165/104.19, 104.28
See application file for complete search history.

(56) References Cited

U.S. PATENT DOCUMENTS 2,590,117 A * 3/1952 Nordlund ..... 122/355
(Continued)

FOREIGN PATENT DOCUMENTS

DE 33 12 791 A1 10/1984
(Continued)

OTHER PUBLICATIONS

International Search Report dated Sep. 29, 2005, which issued in corresponding International Application No. PCT/FI2005/000303.

(Continued)

*Primary Examiner* — Gregory A Wilson
(74) *Attorney, Agent, or Firm* — Fitzpatrick, Cella, Harper & Scinto

(57) ABSTRACT

A method of protecting a heat exchanger that includes a flue gas cooler having plastic heat recovery tubes arranged on a counterflow principle in heat exchange connection with flue gases generated by a thermal power boiler. The heat recovery tubes are connected by an inlet chamber to an inlet tube and by an outlet chamber to an outlet tube, which form, together with a heater, a liquid cycle in which a liquid heat exchange medium is recirculated by a pump. The method includes guiding vapor, which is generated at an end portion of the heat recovery tubes, to a protection circuit that is separate from the liquid cycle, by guiding the vapor along a separate flow channel from the outlet chamber to an upper portion of an expansion vessel, and guiding a liquid heat exchange medium from a lower portion of the expansion vessel directly to the inlet chamber or to the inlet tube, in a vicinity of the inlet chamber, by a separate return duct, so as to enable natural circulation of the heat exchange medium in the heat recovery tubes without the use of external energy.

17 Claims, 3 Drawing Sheets

U.S. PATENT DOCUMENTS

| | | | | |
|---|---|---|---|---|
| 3,601,382 | A | 8/1971 | Sandri et al. | 266/32 |
| 4,137,965 | A * | 2/1979 | Fallon et al. | 165/279 |
| 4,282,926 | A * | 8/1981 | Holland | 165/104.27 |
| 4,327,670 | A * | 5/1982 | Teller | 122/20 B |
| 4,449,571 | A | 5/1984 | Kramert | 165/1 |
| 4,660,511 | A * | 4/1987 | Anderson | 122/420 |
| 6,003,476 | A * | 12/1999 | Semedard et al. | 122/4 D |
| 2010/0320294 | A1 * | 12/2010 | Neumann et al. | 239/556 |

FOREIGN PATENT DOCUMENTS

| | | |
|---|---|---|
| FR | 2 564 746 | 11/1985 |
| GB | 629298 | 9/1949 |
| GB | 806036 | 12/1958 |
| GB | 1 373 967 | 11/1974 |
| JP | 55-11152 | 1/1980 |
| JP | 58-35391 | 3/1983 |
| JP | 1-318893 | 12/1989 |

OTHER PUBLICATIONS

Notification of Transmittal of the International Preliminary Report on Patentability mailed Jul. 25, 2006, issued in International Application No. PCT/FI2005/000303.

* cited by examiner

METHOD OF AND AN APPARATUS FOR PROTECTING A HEAT EXCHANGER AND A STEAM BOILER PROVIDED WITH AN APPARATUS FOR PROTECTING A HEAT EXCHANGER

BACKGROUND OF THE INVENTION

The present invention relates to a method of protecting a heat exchanger against stresses caused by boiling of a heat exchange medium, a protection circuit of a steam boiler and a steam boiler provided with an apparatus for protecting a heat exchanger. The invention especially relates to protecting a heat exchanger without external control or external energy. Preferably, the method and the protection circuit of a heat exchanger in accordance with the present invention are used in situations where heat is recovered from a flue gas flow of thermal power boilers in conditions where there is a risk of, on one hand, condensing of corrosive substances on heat exchange surfaces and, on the other hand, boiling of the water used as a heat exchange medium.

BRIEF SUMMARY OF THE INVENTION

In modem thermal power plants, heat energy from flue gases is efficiently recovered by cooling the flue gases to a temperature as low as possible. A fluidized bed boiler used for the production of electricity is, in the following, provided as an example of such a process in accordance with the prior art. However, the method and the protection circuit of a heat exchanger in accordance with the present invention may be utilized in any kind of steam boiler plant.

The chemical energy of a suitable fuel is converted in a fluidized bed boiler to heat energy by combusting it in a bed of inert material fluidized with air in a furnace of the boiler. Heat energy is recovered both directly with heat surfaces arranged to the furnace walls and with different heat exchangers arranged to the discharge channel of the flue gas. In the parts of the flue gas channel where the temperature of the flue gases and the temperature of the surfaces of the heat exchangers remain sufficiently high, it is possible to manufacture the heat exchangers of relatively inexpensive metal materials.

When the flue gases cool down to a temperature low enough, for example, from 130° C. to 90° C., that the water vapor condenses in droplets on the surfaces of the heat exchanges, which are at temperatures lower than the acid and water dew point, compounds in the flue gases, for example, sulphur dioxide, may dissolve to water droplets and form compounds corroding the metal surfaces. Generally, the aim is to reduce corrosion by manufacturing the heat exchangers of a material that withstands corrosion as much as possible. Recently, especially, when the flue gases contain aggressive compounds, the manufacturers have started to manufacture heat exchangers of suitable plastic materials, too.

In heat exchangers containing plastic pieces, the actual heat exchange tubes, which come into contact with flue gases, are usually U-formed plastic tubes, which are attached at the upper end to metal headers. The headers, on the other hand, are mounted to a recycling piping for a heat exchange medium, most usually, water.

In the joints between the heat exchange piping and the headers, seals are used, which seals are manufactured of plastic or rubber material enduring well, in use, both corrosion and other stresses typical of the operating conditions, but their weakness is the mounting of the plastic tubes to the headers and, especially, the seals used in the joints.

The seals of the joints have proved to poorly endure pressure strikes, which may be generated in situations, where the water in the liquid cycle of the heat exchanger is allowed, at least locally, to boil uncontrollably and to generate steam. When the steam in the water flowing in the plastic tubes and the headers condenses, local point-like pressure strokes are generated, which may directly hit the seals. The pressure strokes may also cause vibration in the whole heat exchanger, which gradually breaks the seals.

The uncontrollable boiling of the heat exchange medium breaking seals typically results from a disturbance in the cooling water cycle. A disturbance in the cooling water cycle may result either from a power failure, which may stop the whole plant, including the liquid cycle of the heat exchanger, or from an operational disturbance in a circulation pump, or a breakdown of the whole pump or its drive motor. As far as an operational disturbance of the pump is concerned, it might be natural to try to solve the problem by stopping the whole combustion process of the boiler. The furnace, especially, a furnace of a fluidized bed boiler, provides, however, after-heat for some time, so that the transfer of heat to the cooling water does not stop immediately. Thereby, the liquid in the heat exchange tubes situated in the flue gas channel tends to continue to evaporate.

Great Britain patent publication No. 629,298 discloses means for transmitting heat of the flue gases of a steam boiler to an air preheater comprising an expansion vessel in the main heat transfer circuit. French patent publication No. 2,564,746 discloses a heat exchanger with plastic U-shaped tubes in a plant for desulfurizing flue gases.

The present invention solves, for example, the above-mentioned problem in such a way that an expansion vessel is mounted into the heat recovery cycle, in communication with a heat exchanger, so that the steam generated in the piping of a heat exchanger is allowed to be controllably discharged to the expansion vessel.

Other characterizing features of a method of and an apparatus for protecting a heat exchanger, and a steam boiler, comprising means for protecting a heat exchanger, become evident in the accompanying claims.

BRIEF DESCRIPTION OF THE DRAWINGS

A method of and an apparatus for protecting a heat exchanger, and a steam boiler, comprising means for protecting a heat exchanger, are explained in more detail with reference to the accompanying drawings, in which.

DETAILED DESCRIPTION OF THE PREFERRED EMBODIMENTS

Figure 1:
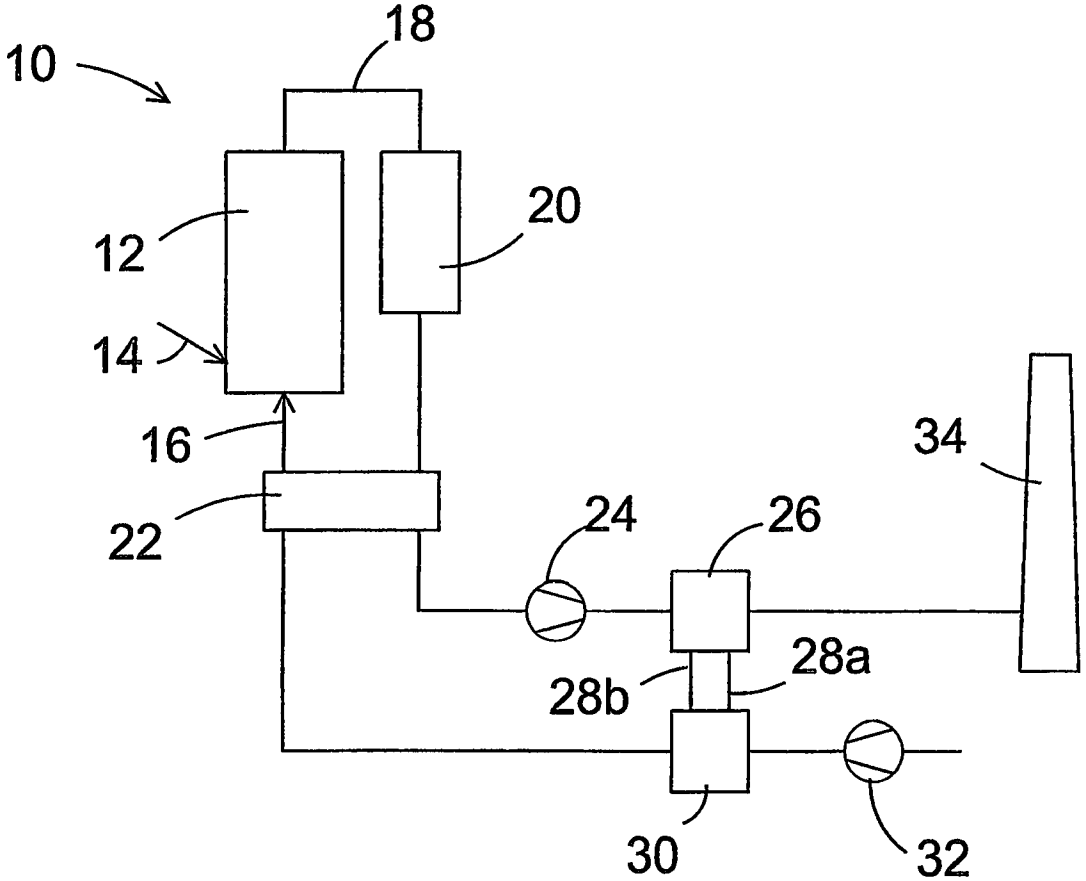
FIG. 1 is a schematic view of a thermal power plant in accordance with the prior art.

FIG. 1 schematically illustrates parts of a thermal power plant 10 in accordance with the prior art, as far as the parts are pertinent to the discussion of the present invention. Fuel 14 and combustion air 16 are introduced to a furnace 12 of the plant 10, generating flue gases, the temperature of which is generally about 800° C. to about 950° C. Hot flue gases are introduced from the furnace along a flue gas duct 18 to a heat recovery section 20, in which steam is generated by means of heat energy from the flue gases, and the temperature of the flue gases decreases, for example, to about 250° C. to about 450° C. The flue gases are supplied from the heat recovery section 20 to a regenerative preheater 22 for combustion air, in which preheater, the temperature of the flue gases further decreases, typically, to about 150° C.

When the desire to utilize as great a share as possible of the heat energy of the flue gases, the flue gases may be guided from the regenerative preheater 22 for combustion air further through a flue gas blower 24 to a flue gas cooler 26. In the cooler 26, the heat energy of the flue gases is transferred to a medium, usually water, which is recycled by means of flow tubes 28*a* and 28*b* to a preheater 30 for combustion air. Thus, the combustion air, which is supplied by a blower 32, is guided to the furnace 12 through a preheater 30 and a regenerative preheater 22.

Normally, the aim is to cool down the flue gases by the cooler 26 to a temperature as low as possible. When using metal heat exchange piping, the end temperature has to be above the acid dew point of the flue gas, at a minimum, about 100° C. When the heat exchange tubes coming into contact with the flue gas in the cooler 26 are made of plastic, flue gases may be cooled to a temperature below 100° C.

The flue gases are guided from the cooler 26 to a stack 34. The thermal power plant 10 also comprises many other parts, for example, flue gas cleaning equipment and ash treatment equipment. Since they are not important in view of the present invention, they are not illustrated in FIG. 1.

Figure 2:
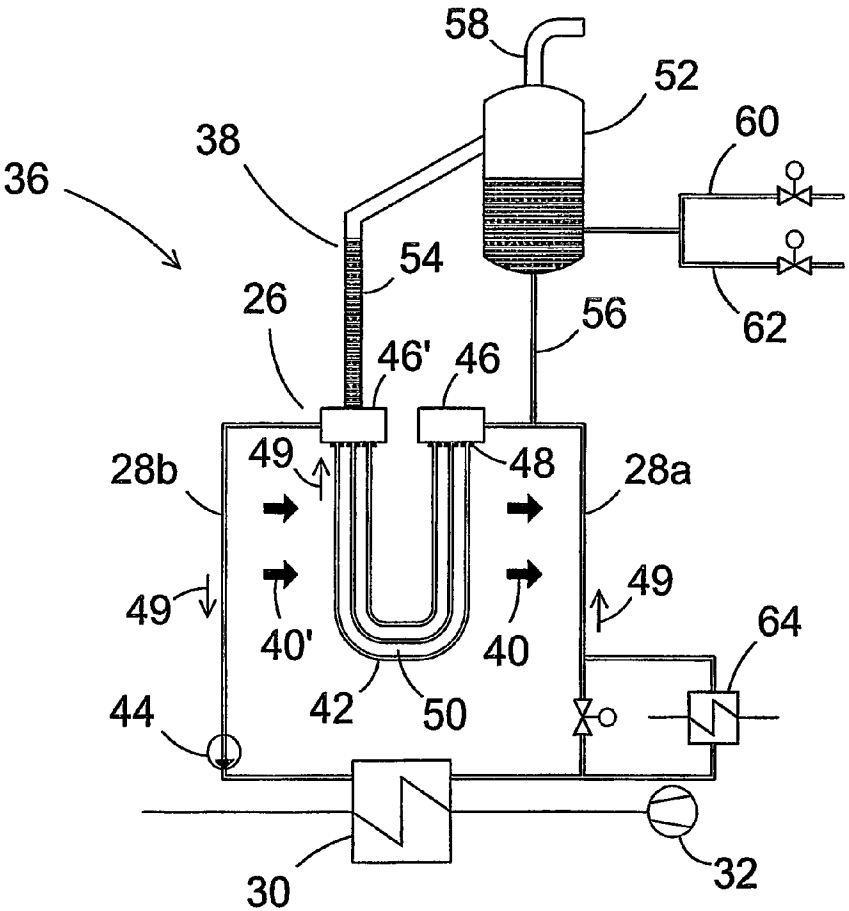
FIG. 2 is a schematic view of a protection circuit of a heat exchanger in accordance with a preferred embodiment of the invention.

FIG. 2 illustrates in more detail a heat exchanger 36, comprising a flue gas cooler 26 and a combustion air preheater 30, which heat exchanger also comprises a protection circuit 38 of a heat exchanger in connection with an atmospheric expansion vessel 52, in accordance with a preferred embodiment of the present invention.

FIG. 2 shows with arrows 40, 40' a flue gas flow, which is cooled indirectly by a liquid heat exchange medium, i.e., in most cases, water, circulated in heat recovery tubes 42 of the heat exchanger 36. The liquid cycle of the heat exchanger 36 comprises, in addition to heat recovery tubes 42, recycling piping 28*a*, 28*b*, in which liquid is recycled by a pump 44. The recycling piping 28*a*, 28*b* is connected with a combustion air preheater 30, in which the medium is cooled again, when heating relatively cold combustion air supplied by a blower 32 by means of heat energy recovered from the flue gas. Alternatively, the heat exchanger 36 may comprise, instead of the combustion air preheater 30, a heat exchanger of some other type, in which heat energy recovered from the flue gas heats a suitable medium.

The heat recovery tubes 42 are U-formed tubes attached at their upper ends by means of seals 48 to the headers 46, 46' in a disconnectable manner. One of the headers (46) of the heat exchanger 36 is an inlet chamber, to which an inlet tube 28*a* for a liquid cycle of the heat exchanger 36 is connected. Correspondingly, one of the headers (46') of the heat exchanger 36 is an outlet chamber, to which an outlet tube 28*b* of the liquid cycle is attached. The headers 46, 46' are most usually made of steel or of some other suitable metal or metal compound. However, they may, in some cases, also be made of a plastic or suitable composite material.

Heat recovery tubes 42, coming into contact with flue gas, have been assembled in a vertical position in such a way that the gas possible in the tubes, especially steam, may easily rise upwards to the headers 46, 46'. Arrows 49 show the flow direction of water in the heat recovery tubes 42 and in the flow tubes 28*a* and 28*b*. Each heat recovery U-tube 42 is usually connected as a so-called countercurrent heat exchanger. In other words, water flows in such a way that the incoming water flow, i.e., water flow flowing down from the inlet chamber (that is, from header 46) is on the cooler side, i.e., on the side of the outflowing flue gas 40, and, correspondingly, the outflowing water flow, i.e., the water flow rising to the outlet chamber (that is, to the header 46') is on the hotter side, i.e., on the side of the in-coming flue gas flow 40'.

By means of a countercurrent coupling, it is possible to minimize the end temperature of the flue gas. Moreover, if hot flue gas causes boiling of a medium in the tubes 42, the boiling begins at the rising end portion of the tubes 42, which intensifies the liquid cycle. At the same time, possible steam bubbles accumulate to the outlet chamber (that is, header 46').

Figure 3:
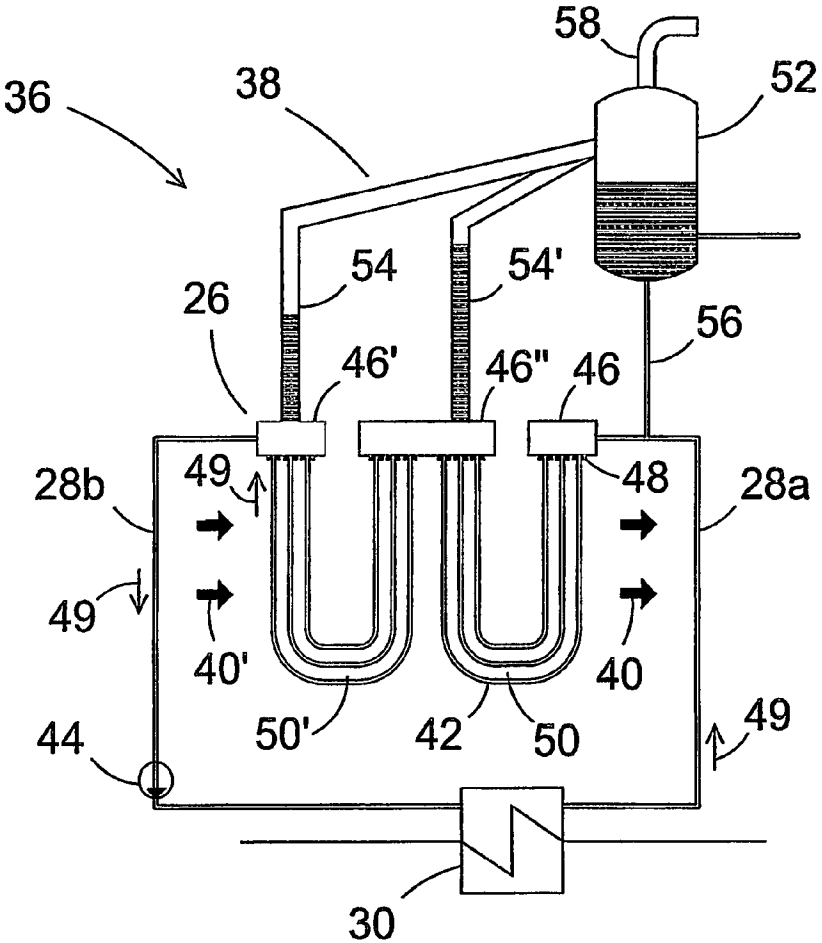
FIG. 3 is a schematic view of a protection circuit of a heat exchanger in accordance with a second preferred embodiment of the invention.

It may be said that the heat recovery tubes 42 connected between the two headers 46, 46' form a tube group 50. The heat exchanger 36 may comprise two headers 46, 46' and a tube group 50 therebetween, or as illustrated in FIG. 3, three headers 46, 46', 46" and two groups 50, 50' connected in series, of which one is connected between the headers 46 and 46" and the other between the headers 46" and 46'. There may also be more than two tube groups connected in series and, in some cases, the heat exchanger may also comprise tube groups connected in parallel.

When the heat recovery tubes 42 of the heat exchanger are made of plastic, the tubes must be attached to the headers 46, 46', 46" connecting them by using rubber or plastic seals 48. These seals endure well the stresses caused by their normal operational conditions. It has, however, been shown that the seals do not endure intense pressure strokes, which they may receive, if the heat exchange medium is allowed to evaporate uncontrollably in the heat recovery tubes 42.

According to the present invention, there is a protection circuit 38 in connection with the heat exchanger 36, which comprises an expansion vessel 52 and flow channels 54, 54', 56, which join at least some of the headers 46, 46', 46" to the expansion vessel 52. In an arrangement in accordance with FIG. 2, an outlet chamber 46' is connected with a tube 54, which is connected at the upper end to the upper part of the expansion vessel 52, above the liquid surface in the expansion vessel. On the other hand, a tube 56 is connected to the inlet chamber 46, or in the vicinity thereof, the tube being connected at its upper end to the bottom part of the expansion vessel 52.

The flow channels 54, 54' leading to the upper part of the expansion vessel 52 may each separately lead to the expansion vessel 52, or they may, if so desired, be connected at their upper ends to one single flow channel leading to the expansion vessel. A return duct 56 leads from the expansion vessel 52 back to the inlet tube 28*a*, preferably, close to the junction point of the inlet tube 28*a* and the header 46, or to the header 46. In the embodiment illustrated in FIG. 2, a ventilation conduit 58 leads from the expansion vessel 52 to the atmosphere or to some other desired space.

The expansion vessel 52 is situated at a level higher than the headers 46, 46', 46", whereby the liquid columns in the vessel 52 and in the flow channels 54, 54' cause a desired overpressure in the medium of the heat exchanger. For example, when the expansion vessel 52 is situated five meters above the headers, the expansion vessel 52 may be kept atmospheric and still maintain about 0.5 bar over-pressure in the heat recovery tubes 42. Preferably, the bottom of the expansion vessel is about three to about seven meters higher than the level of the headers. When the pump 44 is running, the flow resistance of the heat exchange tubes brings about that the surface of the liquid in the flow channel 54 connected with the outlet chamber 46' is, by an amount caused by the pressure loss, lower than that in the expansion vessel 52.

The apparatus illustrated in FIG. 2 operates in such a way that when the liquid circulation in the heat exchanger 36 is disturbed, for example, when the pump 44 stops, the liquid in the heat recovery tubes 42 begins locally to boil, and forms steam. The generated steam flows especially to the header 46' and from there further along the flow channel 54 to the expansion vessel 52. The steam accumulating in the headers 46' and 46" in the apparatus illustrated in FIG. 3 is led to the upper part of the expansion vessel 52 along channels 54 and 54'.

An advantage of the arrangement in accordance with the present invention is that it enables the liquid circulation in the heat recovery tubes 42 also when the pump 44 has stopped. This is based on the fact that when the pump 44 stops, it equalizes the liquid levels in different branches of a protection circuit 38, but, especially, the hot flue gases impacting the rising part of the heat recovery tubes 42 heat the liquid in the rising part, whereby its density decreases. When the liquid boils in the rising part, a liquid/steam mixture begins to accumulate in the channel 54, whereby the density of the medium column in the channel 54 considerably decreases and its upper surface rises substantially higher than the liquid surface in the expansion vessel 52. Then, liquid begins to move from the channel 54 to the expansion vessel 52 and, further, from the bottom of the vessel 52 along the channel 56 to the inlet channel 46. This so-called natural circulation thus ensures the circulation of liquid in the heat recovery tubes 42 completely without external energy.

Further, two auxiliary water lines with valves are connected to the expansion vessel 52, of which from one, 60, fresh liquid may be supplied to the expansion vessel of a conventional water line of the plant and from the other 62, for example, fire extinguishing water may be supplied. Line 62 is a backup system, which is used when the conventional water supply system has stopped, for example, due to a power failure.

Preferably, flow channels 54, 54', 56 are arranged from each header 46, 46', 46" to the heat expansion vessel 52 in such a way that each of the heat recovery tube groups 50, 50' empties from steam. By doing so, it is possible to prevent the generation of a steam lock in the heat exchanger 36. The flow channels 54, 54' in connection with the end part of all heat recovery tube groups 50, 50' are preferably led to the same height to the wall of the expansion vessel 52 and are connected there tangentially. Thereby, the steam flowing to the expansion vessel from one of the flow channels 54, 54' disturbs as little as possible the steam flowing from the other one of the flow channels 54, 54'. Further, the flow channels 54, 54' are brought to the expansion vessel preferably in such a way that they open to the vessel 52 above the liquid surface thereof.

In the above discussed embodiment, the expansion vessel 52 is illustrated as being in atmospheric pressure, which is the simplest embodiment of the invention, and requires only that the expansion vessel can be assembled high enough in relation to the heat exchanger 36. If such high temperatures are used in the recycling water cycle that the pressurization with the liquid column is not sufficient to prevent the evaporation in a normal situation, it is possible to arrange the expansion vessel to be pressurized. A relief valve opening at a certain pressure is thereby connected to the ventilation conduit 58 of the expansion vessel, this relief valve releasing steam from the expansion vessel, if the pressure begins to rise too much.

FIG. 2 illustrates further an additional preferred embodiment of the invention, i.e., an auxiliary cooler 64 connected to the recycling piping 28*a*, which cooler may be used to cool down the liquid recycling in the piping before it is boiling, and which may be used in connection with the above-described arrangement, but also, independently. The control of when to use this auxiliary cooler may be determined, for example, by the temperature of the liquid recycling in the piping, whereby the cooler may be taken into use automatically, guided by the control system.

As is noted, from the above-described arrangement, a new method of solving problems related with the use of plastic heat exchangers, without the need for external auxiliary energy or control, is provided. It is to be understood from the above that the invention is discussed in view of the most preferred embodiments, and it is not intended to limit the scope of the invention from what is defined in the appended claims.

The invention claimed is:

1. A method of protecting a heat exchanger that includes a flue gas cooler having plastic heat recovery tubes arranged on a counterflow principle in heat exchange connection with flue gases generated by a thermal power boiler, which heat recovery tubes are connected by an inlet chamber to an inlet tube and by an outlet chamber to an outlet tube, which form, together with a heater, a liquid cycle in which a liquid heat exchange medium is recirculated by a pump, said method comprising:

guiding vapor, which is generated at an end portion of the heat recovery tubes, to a protection circuit that is separate from the liquid cycle, by guiding the vapor along a separate flow channel from the outlet chamber to an upper portion of an expansion vessel; and guiding a liquid heat exchange medium from a lower portion of the expansion vessel directly to the inlet chamber or to the inlet tube, in a vicinity of the inlet chamber, by a separate return duct, so as to enable natural circulation of the heat exchange medium in the heat recovery tubes without the use of external energy.

2. A method in accordance with claim 1, further comprising maintaining the surface of the liquid heat exchange medium in the expansion vessel below the junction point of a flow channel.

3. A method in accordance with claim 1, wherein the expansion vessel is atmospheric and arranged at a height level above the heat recovery tubes.

4. A method in accordance with claim 1, wherein the expansion vessel is pressurized.

5. A method in accordance with claim 3, further comprising discharging the vapor from the expansion vessel through a ventilation conduit.

6. A method in accordance with claim 4, further comprising discharging the vapor from the expansion vessel through a ventilation conduit.

7. A method in accordance with claim 1, further comprising transferring energy recovered from the flue gases in the heater to the combustion air to be fed to the boiler.

8. A method in accordance with claim 1, wherein the heat exchange medium used is water.

9. A heat exchanger comprising:

a flue gas cooler having plastic heat recovery tubes that are arranged on a counter flow principle in heat exchange connection with flue gases generated by a thermal power boiler, which heat recovery tubes are connected by an inlet chamber to an inlet tube and by an outlet chamber to an outlet tube, which form together with a heater a liquid cycle in which a liquid heat exchange medium is recirculated by a pump; and a protection circuit that is separate from the liquid cycle, the protection circuit comprising an expansion vessel, wherein the outlet chamber is connected to an upper portion of the expansion vessel by a separate flow channel, and a lower portion of the expansion vessel is directly connected to the inlet chamber, or to the inlet tube in a vicinity of the inlet chamber, by a separate return duct, so as to enable natural circulation of the heat exchange medium in the heat recovery tubes without the use of external energy.

10. A heat exchanger in accordance with claim 9, wherein the expansion vessel is atmospheric and arranged at a level higher than the heat recovery tubes.

11. A heat exchanger in accordance with claim 10, wherein the vertical distance between the expansion vessel and the heat recovery tubes is about three to about seven meters.

12. A heat exchanger in accordance with claim 10, wherein the expansion vessel comprises a ventilation conduit for the discharge of vapor.

13. A heat exchanger in accordance with claim 9, wherein the expansion vessel is pressurized.

14. A heat exchanger in accordance with claim 13, wherein the expansion vessel comprises a ventilation conduit for the discharge of vapor.

15. A heat exchanger in accordance with claim 9, wherein the heater is arranged to transfer energy recovered from the flue gases to the combustion air to be fed to the boiler.

16. A heat exchanger in accordance with claim 9, wherein the heat recovery tubes are U-shaped, mainly vertical tubes.

17. A thermal power boiler, comprising:

a heat exchanger according to claim 9.

* * * * *